United States Patent [19]

Ohannesian

[11] Patent Number: 4,619,027

[45] Date of Patent: Oct. 28, 1986

[54] TOOL FOR INSTALLING AND ALIGNING CAMSHAFT BUSHINGS IN INTERNAL COMBUSTION ENGINES

[76] Inventor: Michael J. Ohannesian, P.O. Box 51, Cotati, Calif. 94928

[21] Appl. No.: 704,706

[22] Filed: Feb. 25, 1985

[51] Int. Cl.[4] ..... B25B 27/14

[52] U.S. Cl. ..... 29/275

[58] Field of Search ..... 29/275, 254, 255, 263, 29/280, 271

[56] References Cited

U.S. PATENT DOCUMENTS

| | | | |
|---|---|---|---|
| 2,430,733 | 11/1947 | Paxson | 29/275 |
| 2,480,866 | 9/1949 | Lusk | 29/271 |
| 3,209,445 | 10/1965 | Moskovitz | 29/275 |
| 4,429,447 | 2/1984 | Davis | 29/275 |

*Primary Examiner*—Robert C. Watson

*Attorney, Agent, or Firm*—David C. Ripma

[57] ABSTRACT

A tool is provided for installing and aligning camshaft bushings in internal combustion engines. The tool includes a guide which fits into the bushing bore of the number one bushing in the engine block. The guide includes a spring-loaded engaging ball and depth shoulder for positioning the guide and orienting it with respect to the oil delivery passage in the engine block. The guide includes a central opening with a keyway, through which a shaft extends. The shaft is slidable with respect to the guide and includes protruding pins which engage the key way to orient the shaft. A working head holds a camshaft bushing, and a spring-loaded ball on the head engages the oil supply opening in the wall of the bushing to angularly orient the bushing on the head. With the shaft pins in the key way, a bushing on the head is exactly aligned with the oil delivery passages in the engine block. The bushings may then be installed by striking the other end of the shaft with a hammer. Depth gauge indicators are also provided.

12 Claims, 4 Drawing Figures

TOOL FOR INSTALLING AND ALIGNING CAMSHAFT BUSHINGS IN INTERNAL COMBUSTION ENGINES

BACKGROUND OF THE INVENTION

The present invention relates generally to the installation and alignment of camshaft bushings in internal combustion engines accurately and quickly, and to the elimination of the risk of misaligned oil delivery and supply passages that can restrict the flow of lubricating oil to the camshaft and other vital parts in an internal combustion engine.

DESCRIPTION OF THE PRIOR ART

Heretofore, in construction of internal combustion engines, the engine block has been cast with a plurality of openings or passages for delivering a flow of lubricating oil to lubricate the camshaft and other vital working parts of said engine. When installing camshaft bushings in an internal combustion engine, it is critical that the oil supply bore provided in the wall of a camshaft bushing is in alignment with the oil delivery passage provided in said engine block so as to permit an optimum, unrestricted flow of lubricating oil to the camshaft and other vital working parts in said engine. Hitherto, tools for installing camshaft bushings in internal combustion engines are not designed or engineerd with the technique for mechanically aligning the oil supply bore provided in the wall of a camshaft bushing with the oil delivery passage provided in said engine block. The prior art relies upon human visual sighting requiring two people. One person visually sights for accuracy of alignment and positioning of the camshaft bushing and verbally transmits the information to the other person who then drives the camshaft bushing into place by the use of a massive slidable driving member on an elongated cylindrical driver shaft. This prior art procedure, or more properly lack of definite procedure, resulted in a very great waste of time, labor and money, and frequently, due to mis-alignment of oil delivery and supply passages, lubricating oil flow is restricted and the camshaft and other vital working parts in said engine are starved for lubricating oil thus resulting in costly damage to said engine.

SUMMARY OF THE INVENTION

Accordingly, it is the object of the present invention to provide a tool for repeatedly installing and mechanically aligning camshaft bushings in internal combustion engines accurately, quickly, easily and safely, and to eliminate the risk of human error in the precise aligning of the lubricating oil supply bore provided in the wall of a camshaft bushing with the oil delivery passage provided in said engine block.

Another object of the present invention is to provide a tool for installing camshaft bushings in internal combustion engines safely, and with no damage to the camshaft bushing or the engine block.

A further object of the present invention is to provide a tool calibrated such as to mechanically bring into alignment the lubricating oil supply bore provided in the wall of a camshaft bushing with the oil supply passage provided in a internal combustion engine block.

Another object of the present invention is to provide a tool calibrated such, as to mechanically gauge the precise depth for positioning a camshaft bushing in the pre-existing bore provided in said engine block.

Another object of the present invention is to provide a tool for installing camshaft bushings in internal combustion engines without the use of a massive slidable driving member mounted on an elongated driver shaft, thus a safer more efficient mode of installing camshaft bushings in said engine block.

Yet another object of the present invention is to provide a tool for installing and mechanically aligning camshaft bushings in internal combustion engines in which similar but differently dimensioned working heads and guides are easily interchanged for installing and mechanically aligning different types of camshaft bushings in different internal combustion engines.

Other objects of the present invention will in part be obvious and will in part appear hereinafter.

The present invention accordingly comprises the features of construction, combination of elements, and arrangement of parts, which will be exemplified in the construction hereinafter set forth and the scope of the present invention will be indicated in the appended claims.

In accordance with a principal feature of the present invention a tool for installing and mechanically aligning camshaft bushings in internal combustion engines comprises an elongated cylindrical driver locator shaft having a plurality of elongated, cylindrical locator pins projecting outwardly from the outer cylindrical surface of the said elongated driver locator shaft.

In accordance with another principal feature of the present invention, said elongated cylindrical driver locator shaft is provided with a plurality of depth gauge grooves on the outer cylindrical surface of the outer part of said driver locator shaft positioned such as to gauge the precise placement depth of a camshaft bushing.

In accordance with another aspect of the present invention, said driver locator shaft is provided with a limited shortened transverse bore at the front, or more specifically the mounting end of said driver and locator shaft, in a position such as to be in alignment with the plurality of said elongated cylindrical locator pins.

In accordance with a further aspect of the present invention, said driver locator shaft is provided with a rigidly mounted pressed on drive head opposite said mounting end.

In accordance with another aspect of the present invention a tool for installing and mechanically aligning camshaft bushings in internal combustion engines comprises a working guide having a cylindrical surface of such diameter as to closely fit within the outer end of the central passage of a pre-existing camshaft bushing bore provided in the engine blocks of internal combustion engines.

In accordance with a further aspect of the present invention, said working guide is provided with a longitudinal, cylindrical bore of such diameter as to be slidably mounted on said driver locator shaft.

In accordance with yet another principal feature of the present invention, said longitudinal cylindrical bore in said guide is provided with a longitudinal key way of such depth and width as to permit said elongated cylindrical locator pins projecting outwardly from the outer cylindrical surface of said dirver locator shaft to pass freely through said longitudinal key way.

In accordance with a further feature of the present invention, the cylindrical surface of the outer cylidrical part of said guide is provided with a transverse bore containing a spring-loaded ball plunger with a limit stop which limits the distance said spring-loaded ball projects outwardly from the cylindrical surface of the outer cylindrical part of said working guide.

In accordance with another aspect of the present invention, said working guide is provided with a shoulder for limiting the penetration of the outer cylindrical part of said guide into the central passage of a pre-existing camshaft bushing bore provided in the engine blocks of internal combustion engines.

In accordance with another feature of the present invention a working head is provided having an outer cylindrical part of such diameter as to closely fit within the outer end of a central passage of a camshaft bushing.

In accordance with yet another principal feature of the present invention, the surface of the outer cylindrical part of said working head is provided with a transverse bore containing a spring-loaded ball plunger with a limit stop which limits the distance said spring-loaded ball projects beyond the surface of the outer cylindrical part of said working head.

In accordance with another aspect of the present invention, said working head is provided with a limited longitudinal, cylindrical bore in the mounting end of said working head.

In accordance with a further aspect of the present invention, said working head is provided with a shoulder for limiting the penetration of the outer cylindrical part of said working head into the outer end of a central passage of a camshaft bushing.

In accordance with yet another aspect of the present invention, said shoulder of said working head is provided with a threaded transverse passage containing a locking device.

The disclosed tool includes a working head having an outer cylindrical part of such diameter as to closely fit within the outer end of a central passage of a camshaft bushing, and a shoulder for limiting the penetration of the outer cylindrical part into the central passage of said camshaft bushing. The outer cylindrical part of said shoulder of the disclosed working head is provided with a threaded transverse passage containing a locking device. A limited longitudinal, cylindrical bore of such diameter as to be replaceably mounted on a driver locator shaft is provided in the mounting end of the disclosed working head. The outer cylindrical part of the disclosed working head is provided with a transverse bore containing a spring-loaded ball plunger. Said spring-loaded ball is provided with a limit stop which limits the distance by which the outer end of the spring-loaded ball projects beyond the surface of the outer cylindrical part. When the disclosed working head is not in use, the spring-loaded ball projects outwardly from the surface of the outer cylindrical part to the maximum distance permitted by the limit stop. When the disclosed tool is put to use, the outer end of the outer cylindrical part of the disclosed working head is inserted into the central passage of a camshaft bushing, and then the spring-loaded ball is depressed against the urging of its loaded srping, to bring its upper end flush with the surface of the outer cylindrical part, and thus permit the entire outer cylindrical part to be thrust into the central passage of a camshaft bushing until said shoulder of the disclosed working head bears against the camshaft bushing. The distance between said shoulder of the disclosed working head and the spring-loaded ball projecting outwardly from the outer cylindrical surface is such that when the outer cylindrical part of the disclosed working head is fully inserted in the outer end of a central passage of a camshaft bushing, and said shoulder is brought to bear on the outer end of said camshaft bushing, rotation of the disclosed working head about its axis will bring said spring-loaded ball into alignment with a pre-existing oil supply bore in the wall of said camshaft bushing, and the spring-loaded ball will be urged into said oil supply bore by its loading spring, thus securing said camshaft bushing to the disclosed working head.

The disclosed tool includes an elongated, cylindrical driver locator shaft. Said driver locator shaft is provided with a plurality of transverse cylindrical bores containing elongated cylindrical locator pins of such diameter as to be pressed into place. The outer ends of said elongated cylindrical locator pins project outwardly to a distance that will permit passage of said elongated cylindrical locator pins through a longitudinal key way in the longitudinal, cylindrical bore of a working guide of the present invention and will in part be obvious and in part appear hereinafter. The outer cylindrical surface of the disclosed elongated, cylindrical driver locator shaft is provided with a plurality of depth gauge grooves on its outer cylindrical surface positioned such as to gauge the proper placement depth of a camshaft bushing in the pre-existing bore in an engine block of an internal combustion engine. The front, or more specifically, the mounting end of the disclosed driver locator shaft is provided with a shortened transverse bore to receive a locking device contained in said threaded transverse passage in the mounting end of the disclosed working head. Said shortened transverse bore is positioned such that it is in alignment with a plurality of said elongated, cylindrical locator pins projecting outwardly from the outer cylindrical surface of the disclosed elongated, cylindrical driver locator shaft. A drive head with a limited longitudinal, cylindrical bore of such diameter that it must be pressed on and is rigidly affixed to the disclosed elongated, cylindrical driver locator shaft opposite end of drive head is provided for the purpose of absorbing shocks of repeated strikes from a heavy duty hammer when the disclosed tool is in use.

The disclosed tool includes a working guide having an outer cylindrical part of such diameter as to closely fit within the outer end of a central passage of a pre-existing bore in the engine block of an internal combustion engine, and a shoulder for limiting the penetration of the outer cylindrical part into the central passage of said pre-existing bore provided in said engine block. The outer cylindrical part of the disclosed working guide is provided with a threaded transverse bore containing a spring-loaded ball plunger. The spring-loaded ball is provided with a limit stop which limits the distance by which the outer end of the spring-loaded ball projects beyond the cylindrical surface of the outer cylindrical part. When the disclosed working guide is not in use, the spring-loaded ball projects outwardly from the cylindrical surface of the outer cylindrical part to a maximum distance permitted by the limit stop. When the disclosed tool is put to use, the outer cylindrical part of the disclosed working guide is inserted into the central passage of a pre-existing bore provided in said engine block, and the spring-loaded ball is depressed against the urging of its loading spring to bring its upper end flush with the cylindrical surface of the outer cylindrical part, and thus permit the entire cylindrical part to be thrust into the central passage of a pre-existing bore provided in an engine block of an internal combustion engine until the shoulder bears against said engine block. The distance between said shoulder of the disclosed working guide and the spring-loaded ball projecting outwardly from its outer cylindrical surface of its outer part is such that when the outer cylindrical part of the disclosed working guide is fully inserted in the outer end of a central passage of the front, or more specifically, the number one pre-existing camshaft bushing bore in an engine block of an internal combustion engine, and the shoulder brought to bear on the outer end of said pre-existing camshaft bushing bore in said engine block, rotation of the guide about its axis will bring the spring-loaded ball into alignment with a pre-existing oil supply passage in the wall of said pre-existing camshaft bushing bore, and the spring-loaded ball will be urged into said supply passage by its loading spring, thus securing the disclosed working guide to said pre-existing camshaft bushing bore in said engine block. The disclosed working guide has a longitudinal, cylindrical bore of such diameter as to permit it to be slidably mounted on the disclosed driver locator shaft. Said longitudinal, cylindrical bore in the disclosed working guide is provided with a longitudinal key way the full length of said longitudinal cylindrical bore of such depth and width as to permit said elongated cylindrical locator pins projecting outwardly from the outer cylindrical part of the disclosed elongated driver locator shaft to pass freely through said longitudinal key way.

With the disclosed working guide slidably mounted on the disclosed elongated driver locator shaft and said guide full inserted in the outer end of the central passage of the number one, or more specifically the front pre-existing camshaft bushing bore provided in an engine block of an internal combustion engine, said shoulder brought to bear on the outer end of said pre-existing bore of said engine block, and rotation of the disclosed guide about its axis to bring the spring-loaded ball into alignment with a pre-existing oil supply passage in the wall of said pre-existing camshaft bushing bore, said spring-loaded ball is urged into said oil supply passage by its loading spring, thus securing the disclosed working guide to said camshaft bushing bore in said engine block.

The disclosed working head is replaceably mounted on the outer, or more specifically the mounting end of the disclosed driver locator shaft. Rotation of the disclosed working head about its axis will bring the threaded transverse passage containing a locking device in the mounting end of the disclosed working head into alignment with the shortened transverse bore provided in the mounting end of the disclosed driver locator shaft as to permit said locking device to penetrate, thus rigidly locking the disclosed working head to the disclosed driver locator shaft to a position as to bring the outer end of the spring-loaded ball projecting beyond the cylindrical surface of the outer part of the disclosed working head into alignment with a plurality of elongated cylindrical locator pins projecting outwardly from the outer cylindrical surface of the disclosed driver locator shaft.

The disclosed driver locator shaft is rotated about its axis to a point as to permit a said cylindrical locator pin to enter said key way in the disclosed working guide.

With the disclosed working guide secured by the urging of its spring-loaded ball into the oil supply passage provided in the number one, or more specifically, the front pre-existing camshaft bushing bore in said engine block, and the disclosed working head is rigidly mounted on the disclosed driver locator shaft to a position as to bring the outer end of the spring-loaded ball projecting beyond the cylindrical surface of the outer part of the disclosed working head into alignment with said plurality of elongated cylindrical locator pins projecting outwardly from the outer cylindrical surface of the disclosed driver locator shaft, and the disclosed working head is full inserted into the outer end of a central passage of a camshaft bushing, and said shoulder is brought to bear on the outer end of said camshaft bushing, and the disclosed working head is secured to the camshaft bushing by the urging of its spring-loaded ball in said oil supply bore in said camshaft bushing.

With the disclosed working guide and disclosed working head, and camshaft bushing thusly secured, and an elongated cylindrical locator pin projecting outwardly from the outer cylindrical surface of the disclosed driver locator shaft is entrapped in said longitudinal key way provided in said longitudinal cylindrical bore in the disclosed working guide, said oil supply bore in the wall of the camshaft bushing is in alignment with a plurality of oil supply passages provided in pre-existing camshaft bushing bores in the engine blocks of internal combustion engines.

Further, with the disclosed tool thusly secured, said driver head pressed onto the driving end of the disclosed driver locator shaft can be repeatedly struck with a heavy duty hammer, driving the camshaft bushing to a distance as to bring said scribed markings on the outer cylindrical surface of the disclosed driver locator shaft flush with the face of the disclosed working guide, thus, camshaft bushing is accurately positioned for optimum, unrestricted oil supply flow to the camshaft and other vital working parts in an internal combustion engine.

DESCRIPTION OF THE PREFERRED EMBODIMENT

Figure 1:
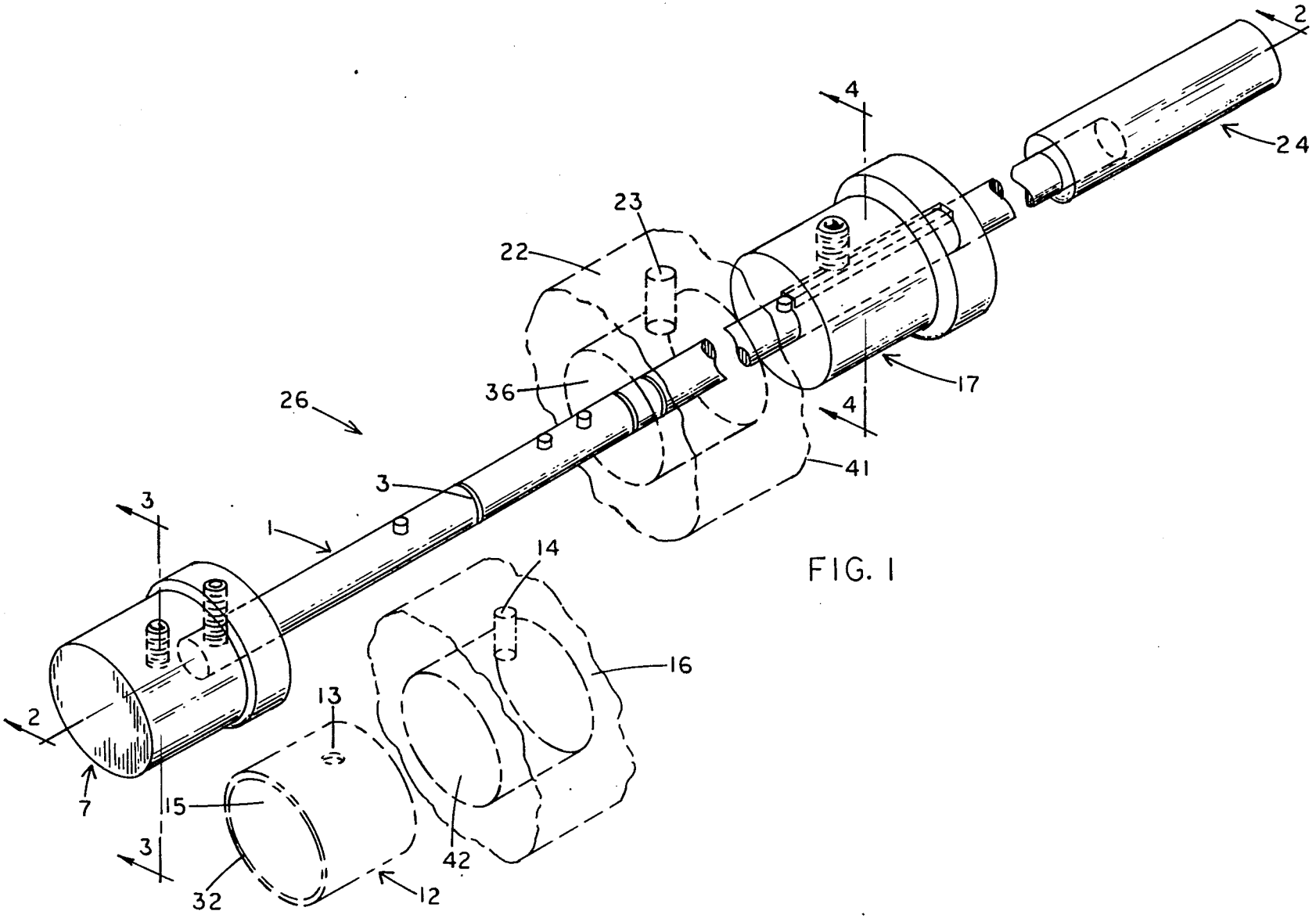
FIG. 1 is a perspective view of the camshaft bushing installing and aligning tool of the present invention, a camshaft bushing such as would be installed by the tool of the present invention, and a fragmentary portion of the block of an internal combustion engine in which the camshaft bushing is installed, and an additional fragmentary portion of the number one, or more specifically the front pre-existing camshaft bushing bore in the block of an internal combustion engine in which the working guide is inserted when the tool is put to use.

Referring now to FIG. 1, there is shown a tool 26 for installing and mechanically aligning camshaft bushings in internal combustion engines embodying the present invention and a cylindrical camshaft bushing 12, of the kind which tool 26 is adapted to install in an internal combustion engine block 16 (shown in part only).

As also shown in FIG. 1, tool 26 generally comprises a working head 7, an elongated cylindrical driver locator shaft 1, a working guide 17, and a drive head 24, affixed to the opposite end of elongated cylindrical driver locator shaft 1 from working head 7.

Internal combustion engine block 16, may, for instance, be a Cummins Diesel Engine block, or the like, it being understood that working head 7, and working guide 17, and cylindrical drive locator shaft 1, will in general be dimensioned to properly inter-engage with a particular model, or group of models, of internal combustion engines, and that several different working heads, working guides and cylindrical drive locator shafts may be required if the tool of the invention is employed in a shop in which a wide variety of internal combustion engines are serviced.

Figure 2:
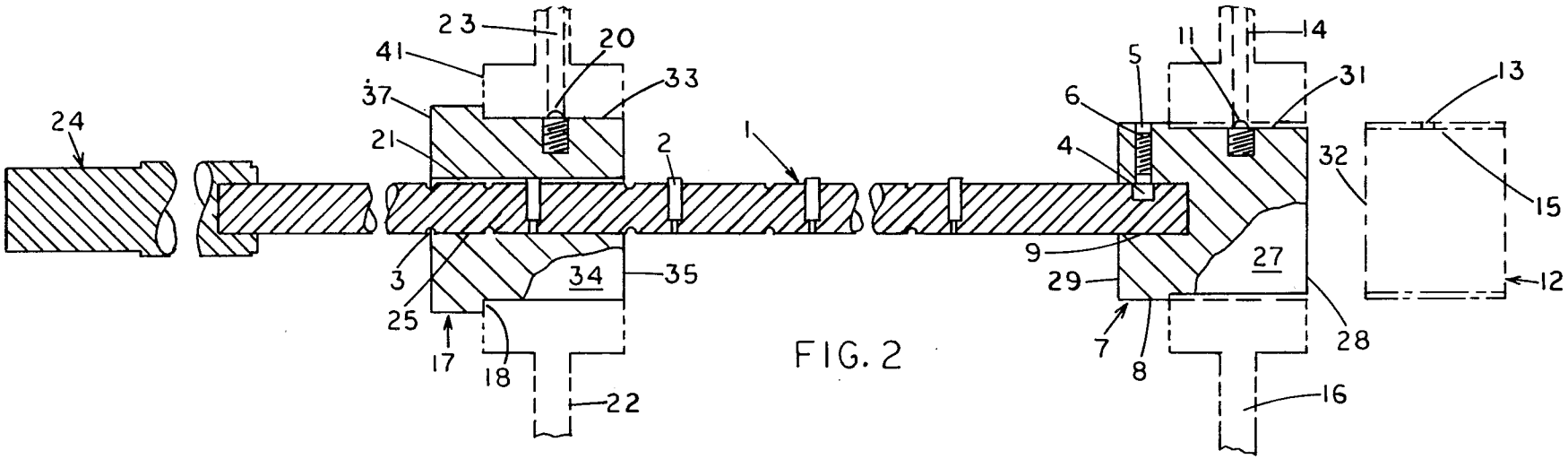
FIG. 2 is a central sectional view of the camshaft bushing installing and aligning tool of FIG. 1.

Referring now to FIG. 2, it will be seen that working head 7, comprises a cylindrical main body 31, having at its outer end 28 an outer cylindrical part 27, which is of such diameter as to closely fit within the central passage 15, of camshaft bushing 12.

As also seen in FIG. 2, outer cylindrical part 27 extends from the outer end 28 of working head 7 to a shoulder 8 located between outer end 28 and inner end 29 of working head 7. (FIG. 3)

As also seen in FIG. 2, one end of elongated cylindrical driver locator shaft 1 closely fits within limited longitudinal cylindrical bore 9 in the inner end 29 (or mounting end) of working head 7. When elongated, cylindrical driver locator shaft 1 is bottomed on the end of limited longitudinal cylindrical bore 9 (FIG. 3) a shortened transverse bore 4 extending partially through elongated cylindrical driver locator shaft 1 can be brought into alignment with threaded transverse passage 5 which passes completely through shoulder 8 of working head 7 to limited longitudinal cylindrical bore 9 in mounting end 29 of working head 7. Shaft 1 is then affixed to working head 7 by means of a locking device such as a threaded dog point allen screw. Elongated cylindrical driver locator shaft 1 is thus strongly and rigidly affixed to working head 7, but at the same time working head 7 may be removed from elongated cylindrical drive locator shaft 1 to permit replacement of working head 7 with a different working head adapted to coact with different camshaft bushings without damaging either elongated cylindrical cylindrical driver locator shaft 1 or working head 7.

Figure 3:
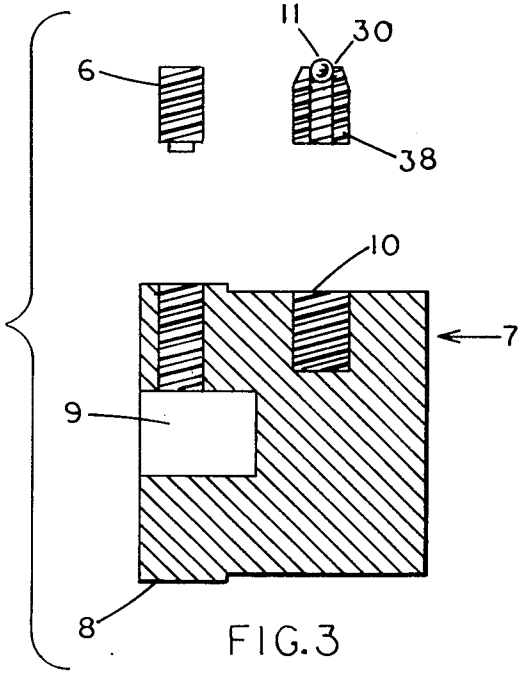
FIG. 3 is an exploded sectional view of the working head of the camshaft bushing installing and aligning tool of FIG. 1.

As best seen in FIG. 3, working head 7 is provided with a threaded transverse passage 10 to contain spring-loaded ball plunger 38 provided with a limit stop 30 which limits the distance by which spring-loaded ball 11 projects beyond the surface of the outer cylindrical part 27 of working head 7.

The distance from shoulder 8 to the center of threaded transverse passage 10 is made equal to the distance between a radial oil supply passage 13 and the outer end 32 of camshaft bushing 12 (FIG. 1). The diameter of the outer end of spring-loaded ball 11 is made slightly smaller than the inner diameter of said radial oil supply passage 13. Thus, it will be understood by those having ordinary skill in the art, informed by the present disclosure, that when working head 7 is inserted into the central passage 15 of camshaft bushing 12 (FIG. 1) until shoulder 8 of working head 7 contacts the outer end 32 of camshaft bushing 12, and then working head 7 is rotated 360° or less about its axis, spring-loaded ball 11 will engage said radial oil supply passage 13, securing working head 7 to camshaft bushing 12.

Referring again to FIG. 2, it will be seen that working guide 17 comprises a cylindrical main body 33 having at its outer end 35 and outer cylindrical part 34 which is of such diameter as to closely fit within the central passage 36 of number one camshaft bushing bore in engine block 22 of an internal combustion engine (FIG. 1).

Figure 4:
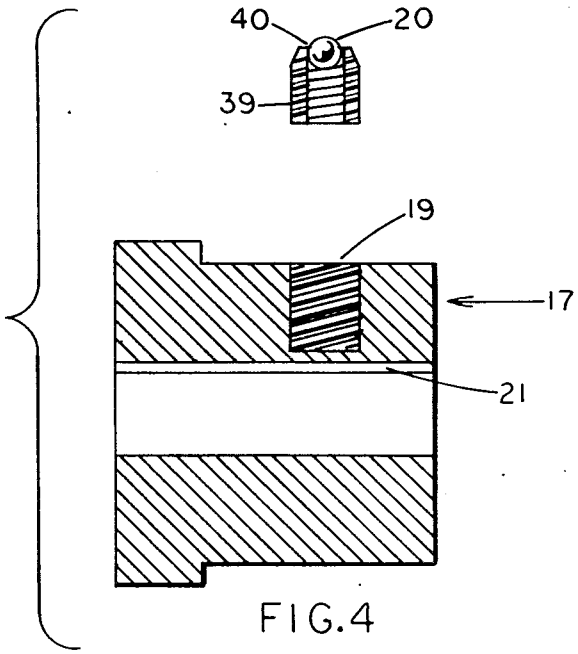
FIG. 4 is an exploded sectional view of the working guide of the camshaft bushing installing and aligning tool of FIG. 1.

Also seen in FIG. 2, the cylindrical surface of the outer cylindrical part 34 extends from the outer end 35 of working guide 17 to a shoulder 18 located between outer end 35 of working guide 17 and inner end 37 of working guide 17 (FIG. 4).

As may be seen in FIG. 2, a longitudinal cylindrical bore 25 which passes completely through working guide 17 from the outer end 35 of working guide 17 extending to inner end 37 of working guide 17.

As may be seen by comparison of FIG. 2 with FIG. 4 a key way 21 passing completely through longitudinal cylindrical bore 25 in working guide 17 from outer end 35 of working guide 17 extending to inner end 37 of working guide 17.

Also seen by comparison of FIG. 2 with FIG. 4 elongated cylindrical locator pins 2 projecting outwardly from elongated cylindrical driver locator shaft 1 are slidably inserted in said logitudinal cylindrical bore 25 of working guide 17 entering key way 21 provided in said longitudinal cylindrical bore 25.

As also seen in FIG. 2 depth gauge grooves 3 provided on the outer cylindrical surface of elongated cylindrical driver locator shaft 1 passing through said longitudinal cylindrical bore 25.

Working guide 17 slidably mounted on elongated cylindrical driver locator shaft 1 may be removed from elongated cylindrical driver locator shaft 1 to permit replacement of working guide 17 with a different working guide adapted to coact with different engine blocks without damaging either elongated cylindrical driver locator shaft 1 or working guide 17.

As best seen in FIG. 4, working guide 17 is provided with a threaded transverse passage 19 to contain spring-loaded ball plunger 39 (replaceable) provided with a limit stop 40 which limits the distance by which the outer end of the spring-loaded ball 20 projects beyond the cylindrical surface of the outer cylindrical part 34 of working guide 17.

The distance from shoulder 18 to center of threaded transverse passage 19 is made equal to the distance between a radial oil supply passage 23 and the outer end 41 of number one camshaft bushing bore in the engine block 22 of an internal combustion engine (FIG. 1). The spherical diameter of spring-loaded ball 20 is made slightly smaller than the diameter of said radial oil supply passage 23. Thus, it will be understood by those having ordinary skill in the art, informed by the present disclosure, that when working guide 17 is inserted into the central passage 36 of the number one camshaft bushing bore of engine block 22 (FIG. 1) until shoulder 18 of working guide 17 contacts the outer end 41 of number one central passage 36 camshaft bushing bore in engine block 22 (FIG. 1) and then working guide 17 is rotated 360° or less about its axis, spring-loaded ball 20 will engage said radial oil supply passage 23, securing working guide 17 to engine block 22.

OPERATION

In using the tool 26 of the present invention to install and mechanically align camshaft bushings in internal combustion engines, worn out bushings first having been removed from the engine block and tool 26 has been assembled for use by slidably mounting working guide 17 onto elongated cylindrical driver locator shaft 1, and head 7 is affixed to elongated cylindrical driver locator shaft 1 opposite drive head 24 by means of engaging locking device 6 passing through shoulder 8 or working head 7 into shortened transverse bore 4 in elongated cylindrical driver locator shaft 1, thus, working head 7 is rigidly and strongly affixed in a position so as to bring the outer end of spring-loaded ball 11 into vertical alignment with a plurality of elongated cylindrical locator pins 2 projecting outwardly from the outer cylindrical surface of the elongated cylindrical driver locator shaft 1 (FIG. 2) whereupon the entire tool can be moved toward the engine block, thus allowing insertion of the outer end 28 of working head 7 deeply into the camshaft passage of the engine block to a position whereby first camshaft bushing is to be installed.

Working guide 17 is fully inserted into the central passage 36 of the number one camshaft bushing bore in engine block 22 (FIG. 2) until shoulder 18 of working guide 17 contacts the outer end 41 of camshaft bushing central passage 36 in engine block 22 (FIG. 2). In this position the distance from shoulder 18 to center of spring-loaded ball 20 is equal to the distance between radial oil supply passage 23 and the outer end 41 of number one camshaft bushing bore in engine block 22 (FIG. 1), working guide 17 is rotated 360° or less about its axis, spring-loaded ball 20 will engage said radial oil supply passage 23 securing working guide 17 to engine block 22 (FIG. 2).

Working head 7 is fully inserted into the central passage 15 of camshaft bushing 12 (FIG. 2) until shoulder 8 of working head 7 contacts the outer end 32 of camshaft bushing 12. In this position the distance from shoulder 8 to center of spring-loaded ball 11 is equal to the distance between radial oil passage 13 and the outer end 32 of camshaft bushing 12 (FIG. 2) and then when camshaft bushing 12 is rotated 360° or less about its axis, spring-loaded ball 11 will engage radial oil supply passage 13 securing camshaft bushing 12 to working head 7.

Rotation of elongated cylindrical driver locator shaft 1 360° or less about its axis will bring elongated cylindrical locator pins 2 projecting outwardly from elongated cylindrical driver locator shaft 1 into alignment with key way 21 provided in longitudinal cylindrical bore 25 in working guide 17, thus permitting elongated cylindrical driver locator shaft 1 to be thrust forward entrapping elongated cylindrical locator pin 2 in key way 21 before camshaft bushing 12 mounted and secured on main body 31 of working head 7 (FIG. 2) starts to enter central passage 42 of camshaft bushing bore in internal combustion engine block 16 (FIG. 1).

Tool ready for use positioned thusly brings into alignment oil supply passage 14 in internal combustion engine block 16, radial oil supply passage 13 in camshaft bushing 12, spring-loaded ball 11 projecting outwardly from working head 7, locking device 6 in shoulder 8 of working head 7 (FIG. 3), into shortened transverse bore 4 extending through in elongated cylindrical driver locator shaft 1, elongated cylindrical locator pins 2 projecting outwardly from elongated cylindrical driver locator shaft 1 with key way 21 provided in longitudinal cylindrical bore 25 in working guide 17 with spring-loaded ball 20 projecting outwardly from outer cylindrical part 34 of working guide 17 with radial oil supply passage 23 (FIG. 2) provided in number one camshaft bushing central passage 36 of engine block 22 (FIG. 1).

Further, with the tool 26 (FIG. 1) positioned and secured by the urging of the spring-loaded ball 20 projecting outwardly from the outer cylindrical part of working guide 17 within the oil supply passage 23 in number one camshaft bushing bore of engine block 22 (FIG. 2) and camshaft bushing 12 mounted on cylindrical main body 31 of working head 7 and secured by the urging of the spring-loaded ball 11 (FIG. 3) projecting outwardly from the outer cylindrical part 27 of working head 7 within the radial oil supply passage 13 in camshaft bushing 12 (FIG. 2) and elongated cylindrical locator pin 2 projecting outwardly from outer cylindrical surface of elongated cylindrical driver locator shaft 1 is entrapped in key way 21 provided in the longitudinal cylindrical bore 25 in working guide 17, the drive head 24 rigidly affixed to elongated cylindrical driver locator shaft 1 opposite working head 7 can be repeatedly struck with a heavy duty hammer driving camshaft bushing 12 mounted on working head 7 to a distance whereby depth gauge groove 3 on the outer cylindrical surface of elongated cylindrical driver locator shaft (FIG. 1) becomes flush with the inner end 37 of working guide 17 (FIG. 2).

It will be seen from the above, that the present invention provides a simple and efficient tool whereby camshaft bushings may be installed in internal combustion engines with a degree of ease, speed, accuracy, and freedom from damage to internal combustion engine blocks not hitherto accomplished.

It will thus be seen that the objects set forth above, among those made apparent from preceding description, are efficiently attained and, since certain changes may be made in the above construction without departing from the scope of the present invention, it is intended that all matter contained in the above description or shown in accompanying drawings shall be interpreted as illustrative only, and not in a limiting sense.

It is also understood that the following claims are intended to cover all of the generic and specific features of the invention herein described, and all statements of the scope of the invention which, as a matter of language, might be said to fall therebetween.

I claim:

1. A tool for installing and aligning camshaft bushings in internal combustion engines such that the oil supply bore extending through the wall of each camshaft bushing is aligned with a corresponding oil delivery passage in the engine block, said tool comprising: a shaft, a working head removably attached to one end of said shaft for holding a camshaft bushing, said working head being insertable into the central passage of a cylindrical camshaft bushing and including positioning means for positioning and securing a camshaft bushing on said working head, said positioning means including spring-loaded engaging means for engaging the oil supply bore of the camshaft bushing to position and rotationally orient the camshaft bushing on said working head, guide means slidably mounted on said shaft, said guide means including a cylindrical part for closely fitting in a bushing receiving bore of an internal combustion engine, a positioning shoulder for limiting the penetration of said cylindrical part of said guide means into the bushing receiving bore, and spring-loaded engaging means on said guide means cylindrical part for engaging the oil delivery passage of the engine which extends through the engine block to the bushing receiving bore, said guide means being positioned for installation of a camshaft bushing when said cylindrical part extends into the bushing receiving bore up to said positioning shoulder and said spring-loaded engaging means engages the oil delivery passage, said guide means including a longitudinal cylindrical bore through which said shaft extends for slidable movement relative to said guide means, said longitudinal cylindrical bore including a key way extending through said guide means, and said shaft including a plurality of locator pins projecting outwardly from said shaft for entering said key way of said guide means whereby said shaft and said working head thereon are aligned with said guide means when a locator pin is in said key way, such that a camshaft bushing on said working head will be installed in alignment with said guide means when said shaft is struck at the end opposite said one end where said working head it attached.

2. A tool as in claim 1 including depth gauge indicator means on said shaft.

3. A tool as in claim 1 including means forming depth gauge markings on said shaft for indicating the depth to which said shaft is to be driven when a camshaft bushing is installed.

4. A tool as in claim 3 in which said guide means includes an outer end to which said cylindrical part extends and an inner end opposite said outer end, said depth gauge markings indicating the maximum distance said shaft is to be driven for alignment of a camshaft bushing when a depth gauge marking is flush with said inner end of said guide means.

5. A tool as in claim 4 in which said means forming depth gauge markings includes grooves formed in said shaft.

6. A tool as in claim 1 in which said working head is removably attached to said shaft by a locking device and said shaft includes means for receiving said locking device such that said working head is aligned with said shaft when said working head is affixed to said shaft by said locking device.

7. A tool as in claim 6 in which said working head includes means forming a transverse passage in said working head, said locking device being positioned in said transverse passage, and said means for receiving said locking device on said shaft includes a short transverse bore at said one end of said shaft into which said locking device extends.

8. A tool as in claim 1 in which said working head is cylindrical, including an outer part for closely fitting within the central passage of a cylindrical camshaft bushing and a shoulder for limiting the penetration of said outer part into the central passage of the camshaft bushing.

9. A tool as in claim 1 in which said spring-loaded engaging means on said working head for engaging the oil supply bore of a camshaft bushing includes a spring-loaded ball plunger having a ball which projects a limited distance beyond the surface of said working head.

10. A tool as in claim 1 in which said spring-loaded engaging means on said cylindrical part of said guide means for engaging the oil delivery passage which extends through the engine block includes a spring-loaded ball plunger having a ball which projects a limited distance beyond the surface of said cylindrical part of said guide means.

11. A tool as in claim 6 in which said plurality of locator pins projecting outwardly from said shaft are aligned with said spring loaded engaging means on said working head when said working head is affixed to said shaft by said locking device.

12. A tool as in claim 1 in which said working head is interchangable with a working head of a different size and said guide means is interchangable with a guide means of a different size such that camshaft bushings of various internal combustion engines can be installed by said tool.

* * * * *